United States Patent [19]

Yoshii et al.

[11] Patent Number: 4,520,246

[45] Date of Patent: May 28, 1985

[54] ON-LOAD TAP CHANGER OF THE TYPE OF VACUUM SWITCHES

[75] Inventors: Toshio Yoshii, Hyogo; Shigeyoshi Furukawa, Kobe, both of Japan

[73] Assignee: Mitsubishi Denki Kabushiki Kaisha, Japan

[21] Appl. No.: 543,040

[22] Filed: Oct. 18, 1983

[30] Foreign Application Priority Data

Jan. 7, 1983 [JP] Japan ..... 58-1351

[51] Int. Cl.[3] ..... H01N 33/66

[52] U.S. Cl. ..... 200/144 B; 200/146 R; 200/11 TC

[58] Field of Search ..... 200/144 B, 146 R, 61.03, 200/11 TC

[56] References Cited

U.S. PATENT DOCUMENTS

| | | | |
|---|---|---|---|
| 3,171,004 | 2/1965 | Luehring | 200/146 R |
| 3,206,569 | 9/1965 | McCarty | 200/61.03 |
| 3,206,580 | 9/1965 | McCarty | 200/144 B |
| 3,445,615 | 5/1969 | Bleibtreu | 200/146 R |
| 3,720,867 | 3/1973 | Rathbun | 200/144 B |
| 3,806,735 | 4/1974 | Breuer et al. | 200/11 TC |

FOREIGN PATENT DOCUMENTS

| | | | |
|---|---|---|---|
| 1293060 | 10/1970 | United Kingdom | 200/11 TC |

*Primary Examiner*—Robert S. Macon

*Attorney, Agent, or Firm*—Leydig, Voit, Osann, Mayer and Holt, Ltd.

[57] ABSTRACT

The invention deals with an on-load tap changer having vacuum type switches, comprising:

first vacuum switches for a main contact of which the ends on one side are connected to a plurality of tap selectors, and of which the ends on the other side are commonly connected; and second vacuum switches for breaking an overload, which are inserted in at least one series circuit consisting of said tap selector and respective of said first vacuum switches for said main contact, which exhibit superior breaking performance to said first vacuum switches for said main contact in said series circuit, which close earlier than said first vacuum switches for said main contact, and which open later than said first vacuum switches for said main contact.

3 Claims, 6 Drawing Figures

ON-LOAD TAP CHANGER OF THE TYPE OF VACUUM SWITCHES

BACKGROUND OF THE INVENTION

1. Field of the Invention

The present invention relates to an on-load tap changer having vacuum type switches.

2. Description of the Prior Art

A contact mechanism of a change-over switch which opens and closes in an insulating oil has heretofore been generally used for on-load tap changers. With this mechanism, however, the insulating oil is subject to contamination by the contacts which open and close. Recently, therefore, an on-load tap changer has been put into practice by using vacuum switches which have a contact mechanism and which do not use insulating oil, as current switching elements of the change-over switch.

FIG. 1 shows a circuit of a conventional on-load tap changer which employs the above-mentioned vacuum switches, and FIG. 2 shows a switching sequence of the contacts.

In FIG. 1, reference numeral 1 denotes a vacuum switch for a main contact on the side of odd-numbered taps, 2 denotes a vacuum switch for a resistance contact, 3 denotes a vacuum switch for a main contact on the side of even-numbered taps, 4 denotes a current-limiting resistor, 5 denotes a tap winding of a transformer, 6 denotes a tap selector on the side of even number, and 7 denotes a tap selector on the side of odd number.

The circuit of FIG. 1 is of the resistance switching system which provides a great advantage when it is used as an on-load tap changer. Further, this system features very simple sequence and operation as shown in FIG. 2. Namely, FIG. 2 illustrates a sequence for changing an odd tap number into an even tap number. On the left side of FIG. 2, the main switch 1 on the side of odd number and the switch 2 for resistance are conductive, and the main switch 3 on the side of even number is nonconductive. To change the tap, first the switch 2 is left on while, the switch 1 is turned off. Then, the switch 3 is turned on and the switch 2 is turned off. From the standpoint of simple construction and small size, this on-load tap changer pertains to a one-resistance system (per phase) which is said to be suited for the on-load tap changer having vacuum type switches. This device, however, has defects as mentioned herebelow.

(a) The breaking duty (breaking current x recovery voltage) of the vacuum switch 3 for the main contact on the side of even-numbered taps where a tapdifference current caused by voltage between odd-numbered taps and even-numbered taps is superposed on the load current when the taps are to be changed, becomes greater than the breaking duty of the vacuum switch 1 for the main contact on the side of odd-numbered taps. When a rated load is to be switched, the breaking duty becomes four times as great (here a current-limiting resistance=-step voltage/rated current which is flowing). When a 200% overload is to be switched, the breaking duty becomes as great as nine times the breaking duty of the vacuum switch 1 for the main contact on the side of odd-numbered taps compared to the case of switching the rated load. Here, the mechanism for operating contacts of the vacuum switch is provided in relation to each of the vacuum switches. Therefore, the individual vacuum switches must have the same size. Accordingly, the size of the vacuum switches must be determined based upon the size of the vacuum switch which has a large breaking duty for switching overload. Therefore, the vacuum switches tend to become large in size, and the tap changer tends to become bulky.

(b) The gap between contacts of the vacuum switch when it is opened, is not allowed to be so increased from the standpoint of maintaining mechanical durability of a bellows which is used for the contact operation mechanism of the vacuum switch. When vacuum switches are employed for the on-load tap changer, therefore, a sufficiently large withstanding voltage is not maintained against impulses caused by lightning.

SUMMARY OF THE INVENTION

The present invention is to preclude the above-mentioned defects inherent in the conventional art. For this purpose according to the present invention, a vacuum switch having excellent breaking performance is connected as a back-up device in series with at least one vacuum switch for a main contact. This makes it possible to provide a compact vacuum switch-type change-over switch which features breaking performance maintaining high reliability.

BRIEF DESCRIPTION OF THE DRAWINGS

In the drawings, the same reference numerals denote the same or corresponding portions.

DESCRIPTION OF THE PREFERRED EMBODIMENTS

Figure 1:
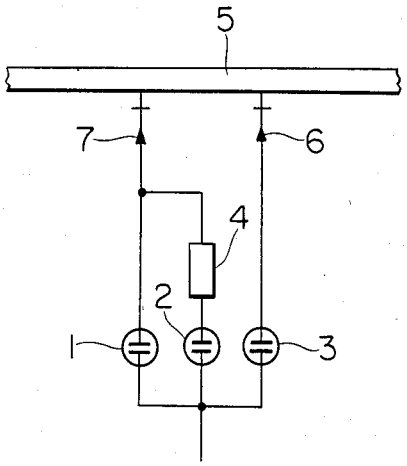
FIG. 1 PRIOR ART
FIG. 1 is a diagram of circuit connection of a conventional vacuum switch-type on-load tap changer.
Figure 2:
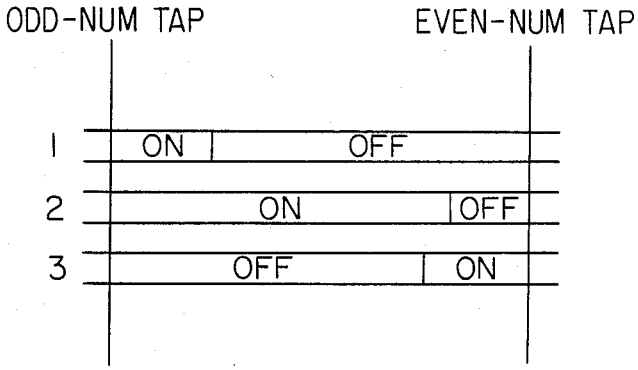
FIG. 2 is a diagram of operation sequence of the conventional on-load tap changer of FIG. 1.

An embodiment of the invention will be described below in conjunction with FIG. 3, in which reference numerals 1 to 7 denote the same portions as those of FIG. 1. What makes the embodiment of FIG. 3 different from the device of FIG. 1 is that a vacuum switch 8 for breaking any overload is inserted between the vacuum switch for the main contact on the side of even-numbered taps and the tap selector 6 on the even-numbered side. The vacuum switch 8 for breaking any overload utilizes a contact material having excellent breaking performance, such as a copper-chromium alloy. The vacuum switch 8 operates to assist the vacuum switch 3 for the main contact on the side of even-numbered taps when it is not capable of breaking the current under overload conditions.

Figure 4:
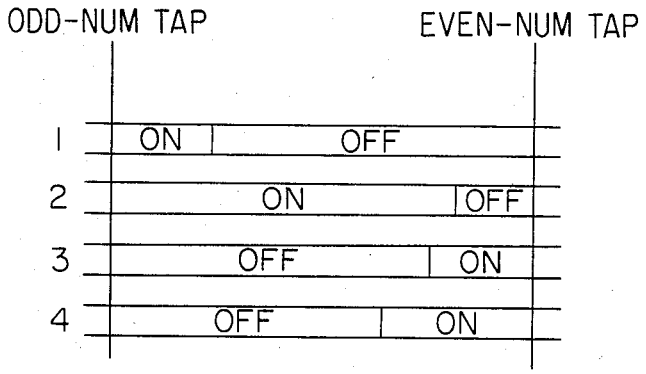
FIG. 4 is a diagram of an operation sequence of the embodiment of FIG. 3.

The operation of the above described embodiment will be described herebelow. As is well known, contacts having very excellent breaking performance exhibit poor resistance against melt-adhesion. Contacts of vacuum switches are usually composed of a copper-tungsten alloy. When the above-mentioned copper-chromium alloy having excellent breaking performance is used, however, resistance against melt-adhesion is inevitably deteriorated. When the contacts composed of the copper-chromium alloy are closed, therefore, they melt and adhere to each other due to heat produced by contact chattering. Namely, the contacts become stuck and cannot be reopened. Because of this reason, the vacuum switch 8 for breaking an overload must necessarily be closed earlier than the vacuum switch 3 for the main contact on the side of even-numbered raps as shown in the switching sequence diagram of FIG. 4.

As can be seen from diagram 4, to change the taps from the side of even-numbered taps to the side of odd-numbered taps, the vacuum switch 3 for the main contact on the side of even-numbered taps is first opened, and the vacuum switch 8 for breaking an overload is opened at least one-half a cycle thereafter. That is, when the contacts are to be opened, the vacuum switch 8 is opened later than the vacuum switch 3 for the main contact.

Thus, when the vacuum switch 3 for main contact is not capable of breaking the current under overload conditions, the vacuum switch 8 for breaking overload backs up the operation to break the current. Therefore, the contacts of the vacuum switch 8 are worn out less, and the backing-up function reliably lasts for extended periods of time.

Accordingly, the vacuum switch 3 for the main contact on the side of even-numbered taps needs have a breaking capacity rated to switch the rated load only. Further, although the vacuum switch 8 for breaking an overload may not have a high resistance against contact melt-adhesion, it permits the use of a contact material which exhibits excellent breaking performance. Therefore, both the vacuum switch 3 for the main contact on the side of the even-numbered taps and the vacuum switch 8 for breaking an overload can be constructed having small capacities and, therefore, in small sizes. This fact makes it possible to design the tap changer in a small size as well as to increase reliability of the breaking performance.

Figure 3:
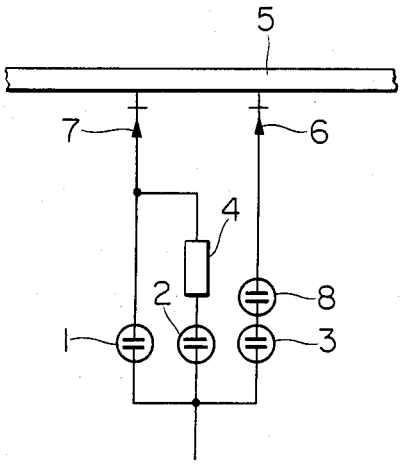
FIG. 3 is a diagram of circuit connection of a vacuum switch-type on-load tap changer according to an embodiment of the present invention.
Figure 5:
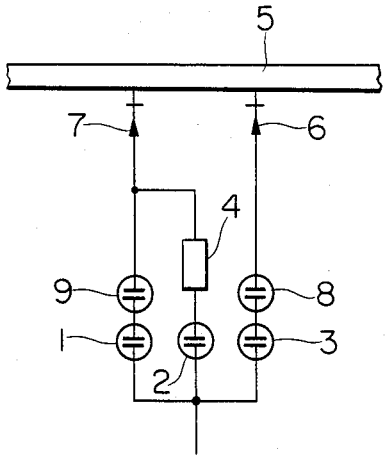
FIG. 5 is a diagram of circuit connection according to another embodiment of the present invention.

FIG. 5 illustrates another embodiment of the present invention, in which reference numerals 1 to 8 denote the same portions as those of FIG. 3. What makes this embodiment different from the embodiment of FIG. 3 is that a vacuum switch 9 for breaking an overload constructed similarly to the vacuum switch 8, is inserted between the vacuum switch 1 for the main contact on the side of odd-numbered taps and the tap selector 7 of the odd-numbered side.

Figure 6:
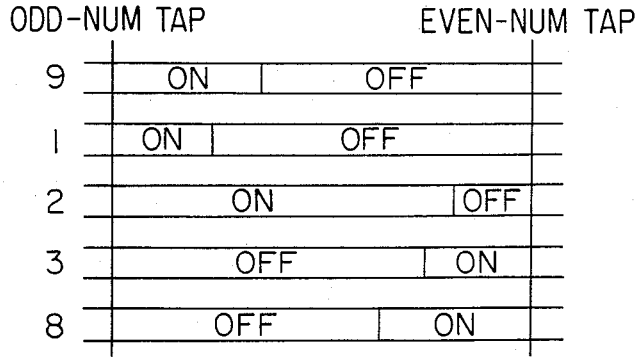
FIG. 6 is a diagram of operation sequence of the embodiment of FIG. 5.

As shown in the switching sequence of FIG. 6, the vacuum switch 9 for breaking an overload is closed earlier than the vacuum switch 1 for the main contact on the side of odd-numbered taps, and is opened later than the vacuum switch 1. Thus, the vacuum switch 9 for breaking an overload backs up the breaking performance of the vacuum switch 1 for the main contact on the side of odd-numbered taps thereby increasing the reliability of the breaking performance. Furthermore, since two vacuum switches are connected in series on both the odd-numbered side and the even-numbered side, the gap between contacts is doubled, and the withstanding voltage against impulses increases between contacts of the changer.

What is claimed is:

1. An on-load tap changer having vacuum type switches, comprising:

first vacuum switches for a main contact of which the ends on one side are connected to a plurality of tap selectors, and of which the ends on the other side are commonly connected; and second vacuum switches for breaking an overload, which are inserted in at least one series circuit consisting of said tap selector and respective of said first vacuum switches for said main contact, which exhibit superior breaking performance to said first vacuum switches for said main contact in said series circuit, which close earlier than said vacuum switches for said main contact, and which open later than said vacuum switches for said main contact.

2. An on-load tap changer as set forth in claim 1, wherein said tap selectors are in pairs, and a series circuit consisting of a current-limiting resistor and a vacuum switch for resistance contact, is connected in parallel with one of said vacuum switches for said main contact.

3. An on-load tap changer as set forth in claim 1, wherein said second vacuum switches for breaking an overload are connected in series with respective of said tap selectors and with said series circuit of said first vacuum switches for said main contact.

* * * * *